US010368165B2

(12) United States Patent
Wan

(10) Patent No.: US 10,368,165 B2
(45) Date of Patent: Jul. 30, 2019

(54) METHOD FOR ELIMINATING MOTOR VEHICLE AND WATER CRAFT HORN EMC INTERFERENCE AND HORN

(71) Applicant: Yu Wan, Heilongjiang (CN)

(72) Inventor: Yu Wan, Heilongjiang (CN)

( * ) Notice: Subject to any disclaimer, the term of this patent is extended or adjusted under 35 U.S.C. 154(b) by 139 days.

(21) Appl. No.: 15/303,487

(22) PCT Filed: Apr. 13, 2015

(86) PCT No.: PCT/CN2015/076419

§ 371 (c)(1),
(2) Date: Dec. 30, 2016

(87) PCT Pub. No.: WO2015/154723

PCT Pub. Date: Oct. 15, 2015

(65) Prior Publication Data

US 2017/0118557 A1 Apr. 27, 2017

(30) Foreign Application Priority Data

Apr. 11, 2014 (CN) ..... 2014 1 0145980

(51) Int. Cl.
*H04R 3/00* (2006.01)
*G10K 9/12* (2006.01)

(52) U.S. Cl.
CPC ..... *H04R 3/007* (2013.01); *G10K 9/12* (2013.01)

(58) Field of Classification Search
CPC . H01L 2224/49175; H01L 2924/19041; G06F 13/4068; G01R 15/16; H01G 4/38; H04R 2225/49; Y02T 10/7022
(Continued)

(56) References Cited

U.S. PATENT DOCUMENTS 4,709,652 A 12/1987 Douglass, Jr. et al.
5,640,457 A * 6/1997 Gnecco ..... H04R 25/60 174/350
(Continued)

FOREIGN PATENT DOCUMENTS

CN 101556466 A 10/2009
CN 202679592 U 1/2013
(Continued)

OTHER PUBLICATIONS

International Search Report (PCT/ISA/210) dated Jul. 13, 2015, by the Chinese Patent Office as the International Searching Authority for International Application No. PCT/CN2015/076419.
(Continued)

*Primary Examiner* — George C Monikang
(74) *Attorney, Agent, or Firm* — Buchanan Ingersoll & Rooney PC

(57) ABSTRACT

A motor vehicle and/or water craft horn, comprising: at least one capacitor (C2) of about 220-10000 μF connected in parallel at the input terminals of the horn power supply to eliminate electromagnetic interference caused by electromagnetic radiation, conduction, and coupling. Also provided are a method of eliminating motor vehicle and/or water craft horn electromagnetic interference, an electronic device for using on a motor vehicle and/or water craft, and a motor vehicle and/or water craft. The present invention solves the problem of overrun out of limit of conducted emission (CE) and radiated emission (RE) when a motor vehicle or water craft uses a horn for CIRS 25 testing, thus enabling the horn EMC index to meet the standard.

19 Claims, 2 Drawing Sheets

(58) Field of Classification Search
USPC ..... 381/151, 312, 86; 307/20
See application file for complete search history.

(56) References Cited

U.S. PATENT DOCUMENTS

| | | | | |
|---|---|---|---|---|
| 2004/0114297 | A1* | 6/2004 | Schmiederer ..... | H01R 39/54<br>361/118 |
| 2009/0110214 | A1* | 4/2009 | Litovsky ..... | H02J 7/0004<br>381/106 |
| 2010/0301793 | A1* | 12/2010 | Jahkonen ..... | H02M 5/458<br>318/503 |

FOREIGN PATENT DOCUMENTS

| | | | |
|---|---|---|---|
| CN | 202711682 | U | 1/2013 |
| CN | 103581811 | A | 2/2014 |
| CN | 203931487 | U | 11/2014 |
| DE | 10 2007 041525 | A1 | 2/2009 |

OTHER PUBLICATIONS

Written Opinion (PCT/ISA/237) dated Jul. 13, 2015, by the Chinese Patent Office as the International Searching Authority for International Application No. PCT/CN2015/076419.

* cited by examiner

METHOD FOR ELIMINATING MOTOR VEHICLE AND WATER CRAFT HORN EMC INTERFERENCE AND HORN

BACKGROUND

Technical Field

The present invention relates to horns of motor vehicles and/or water crafts, in particular to EMC (Electromagnetic Compatibility) in the horns of motor vehicles.

Related Art

At present, 90% of horns of the motor vehicles in the world are electromagnetic horns, which have advantages of being low in manufacturing cost and which have defects of being short in service life and have serious problem in regard of electromagnetic radiation interference. This disadvantage is not serious and neglectable when there were electronic devices on vehicles in the past. Along with the development of times, vehicle-mounted electronic devices are rapidly increased from original radios to the fields of motor control, brake anti-lock, steering engine control, window and door control, air conditioner control, vehicle body control, information system, etc. During the use, the original horn may cause, besides the interference to the radio and television due to electromagnetic interference, abrupt vehicle gear shifting and abrupt ON/OFF of the air conditioner of some vehicle models, even more seriously, the ABS brake system to fail briefly when the horn is pressed, and thus driving safety is greatly affected.

For this purpose, electronic vehicle horns emerged in the 1980's of the last century. Although the electronic horns are greatly improved than electromechanical horns in the aspect of EMC, due to the limitation in cost of the electronic horns and a limited space in the horns per se, the electromagnetic interference generated by an electromagnetic oil of the horn cannot be effectively inhibited; meanwhile, the electronic horn will cause the horn oscillation system abnormal at some frequency points, or even cause oscillation stop to damage the horn when performing high frequency bulk current injection interference test.

In the ON/OFF process of the vehicle-mounted electrical equipment, for example, when the motor or ignition system is on/off, the transient interference phenomenon may be caused by wire bundle distribution capacitance and inductance and, when the horn is tested according to CIRS25, Conducted Emission and Radiated Emission (i.e., the radiated electromagnetic emission harassment test) go severely out of limit at some frequency bands. The horn may be even damaged during BCI interference test and interference pulse injection test in accordance with ISO7637 standard. However, the vehicle manufacturers have no other options. The horn EMC non-compliance has been a difficult problem in the manufacturing industry of the electronic horns.

Since the horn has a metal overally-enclosed shell, the shell of the horn is grounded no matter in test or in use on the vehicles, and about 95% of the conducted emission and radiated emission are leaked from a power supply terminal of the horn. In the EMC test of the existing horns, the conducted emission and radiated emission go seriously out of limit according to the international standard CIRS25 (FIG. 3). Thus, the manufacturers of the electronic horns tried a variety of ways to absorb or inhibit the high frequency electromagnetic interference generated during working of the horn. There are some common methods as follows:

First method: capacitors are used at two ends of driving electromagnet coils, i.e., the main interference generating source, of the horn for absorbing, the defect is that an audio pulse string of driving horn electromagnets is enabled to pass by a bypass of the capacitors when the capacitance of the capacitors is increased to some extent, such that the horn driving current is increased while electromagnet driving power is reduced, the interference inhibition action is not effectively improved, the sound of the horn is reduced, and the first method cannot be used.

Second method: serial capacitors and resistors are adopted at two ends of the of driving electromagnet coils, i.e., the main interference generating source, of the horn for absorbing. The portion of current, bypassed by the capacitor and resistor bypass, of the audio pulse string of the driving electromagnet coils, is reduced and thus the horn driving current is reduced, but the interference inhibition action is not effectively improved, and thus the second method cannot be used.

Third method: transient diodes or fast recovery diodes are mounted at two ends of the driving electromagnet coils of the horn for absorbing. But due to the follow current influence of a diode switch, the horn driving current is increased, but the electromagnet driving power is reduced, the horn power consumption is out of limit, the sound is reduced, and thus the third method cannot be used. Although the driving current increment is reduced to some extent by serially connecting the resistor to the diode, the interference inhibition action is not effectively improved, and the third method cannot be used.

Fourth method, since the working current of the horn is 2-6 A, a conventional method is to add an inductor and a high frequency capacitor (less than 1 microfarad) and a magnet ring at a power source input terminal to filter, but due to a large volume, they cannot be mounted in the horn, the interference inhibition action is not effectively inhibited either, and thus the fourth method cannot be used.

The methods of all forms similar to the above methods are used to absorb the counter emf of the coil, in the final analysis, the problem of CIRS25 interference disqualification is solved by using an absorbing inhibition method, but due to the poor effect, the EMC index of the horn does not conform with the CIRS25 standard always.

SUMMARY

The objective of the present invention is to provide a circuit capable of overcoming the above defects.

In a first aspect, the embodiment of the present invention provides an electronic or electromechanical horn for motor vehicles and/or water crafts, which comprises at least one capacitor with the overall capacitance of about 220-10000 microfarads and connected in parallel with power source input terminals of the horn, so as to eliminate the electrical interference caused by electromagnetic radiation, conduction and coupling. The overall capacitance of the capacitor is preferably about 470-6000 microfarads, and further preferably about 1000-4000 microfarads.

In a second aspect, the embodiment of the present invention provides an electronic or electromechanical horn for motor vehicles and/or water crafts, comprising at least one capacitor connected in parallel with both terminals of a horn power supply, wherein the capacitance of the capacitor is large enough, such that the internal resistance relative to the working frequency of the horn is smaller than a certain threshold, which is about 2Ω, and the capacitor internal capacitance is preferably smaller than 1Ω, and further preferably lower than 0.5Ω.

In a third aspect, the embodiment of the present invention provides an electromagnetic interference eliminating method for an electronic or electromechanical horn of motor vehicles and/or water crafts, comprising connecting at least one capacitor with the overall capacitance of about 220-10000 microfarads in parallel to a power source input terminal of the horn, so as to eliminate the electrical interference caused by electromagnetic radiation, conduction and/or coupling. The overall capacitance of the capacitor is preferably about 470-6000 microfarads, and further preferably about 1000-4000 microfarads.

In a fourth aspect, the embodiment of the present invention provides an electromagnetic interference eliminating method for an electronic or electromechanical horn of motor vehicles and/or water crafts, comprising connecting at least one capacitor in parallel to two ends of a horn power source, wherein the capacitance of the capacitor is large enough, such that the internal resistance relative to the working frequency of the horn is smaller than a certain threshold, which is about 2Ω, and the capacitor internal capacitance is preferably smaller than 1Ω, and further preferably lower than 0.5Ω.

In a fifth aspect, the embodiment of the present provides an electronic device for motor vehicles and/or water crafts, which comprises at least one capacitor with the overall capacitance of about 220-10000 microfarads and connected in parallel to a power source input terminals, so as to eliminate the electrical interference caused by electromagnetic radiation, conduction and/or coupling. The overall capacitance of the capacitor is preferably about 470-6000 microfarads, and further preferably about 1000-4000 microfarads.

In a sixth aspect, the embodiment of the present invention provides an electromagnetic interference eliminating method for an electronic device of motor vehicles and/or water crafts, comprising connecting at least one capacitor with the overall capacitance of about 220-10000 microfarads in parallel to power source input terminals, so as to eliminate the electrical interference caused by electromagnetic radiation, conduction and coupling.

In a seventh aspect, the embodiment of the present invention provides a motor vehicle and/or water craft, comprising an electronic device, and at least one capacitor connected in parallel with both terminals of the electronic device power supply or in lines providing power for the device and having enough capacitance, wherein the capacitor has the overall capacitance of about 220-10000 microfarads, so as to eliminate the electrical interference caused by electromagnetic radiation, conduction and/or coupling. The overall capacitance of the capacitor is preferably about 470-6000 microfarads, and further preferably about 1000-4000 microfarads.

In an eighth aspect, the embodiment of the present invention provides an electromagnetic interference eliminating method for motor vehicles and/or water crafts which comprise electronic devices, the method comprises connecting at least one capacitor to in parallel with terminals of a power source supply of the device or in lines providing power for the device, so as to eliminate the electrical interference caused by electromagnetic radiation, conduction and/or coupling, wherein the capacitance of the capacitor is large enough, and the overall capacitance is about 220-10000 microfarads. The overall capacitance of the capacitor is preferably about 470-6000 microfarads, and further preferably about 1000-4000 microfarads.

The embodiments of the present invention effectively solve the problems that the parts of the frequency bands of Conducted Emission and Radiated emission during the test of the horn according to CIRS25 are severely over-limited, and that the horn is even damaged during BCI interference test and interference pulse injection test in ISO7637 standard.

DETAILED DESCRIPTION

The present invention is clearly and completely specified in detail in combination with drawings and specific embodiments, obviously, the described embodiments are just part of and not all of the embodiments of the present invention. Based on the embodiments in the present invention, all other embodiments gained by those common skilled in the art without any creative work fall within the protection scope of the present invention.

Through research, the solutions of the vehicle horn manufacturers in the past all adopt a high frequency inhibition absorbing method to solve the problem of disqualification of the high frequency band electromagnetic radiation, but the effect is always poor mainly because the level of 42 dBuV is required by the interference level standard of conducted emission and radiated emission generated by the horn to be very low, and the internal resistance of the conventional interference eliminating device is far from enough to effectively absorb the low amplitude value conducted emission and radiated emission.

Through experimental studies of multiple times, the applicant found that, the electronic horns of different designs can totally solve the problem that the CIRS25 radiation is out of limits as long as one or more capacitors (the capacitor can be various types for example, electrolytic capacitor) of 220-10000 microfarads are connected to two ends of a horn power source; in addition, indexes such as Radiated Emission harassment test, Conducted Emission harassment test and BCI (Bulk current injection) harassment test are obviously improved, such that each index of EMC of the electronic horn totally accords with the standard. The overall capacitance of the capacitor is preferably 470-60000 microfarads and further preferably 1000-4000 microfarads.

From the capacitive reactance formula $Xc=1/(2\pi f\ C)$ of the capacitor, it can be seen that as long as the capacitance of the capacitors connected to two ends of a horn power source is large enough, and the internal capacitance relative to the working frequency (3000-600 Hz) of the horn is smaller than a certain threshold value, lower to (mΩ) level, various conducted emission and radiated emission interferences generated in the horn electromagnet can be effectively short-circuited and absorbed in the horn. The threshold value is about 2Ω. Preferably, the capacitor internal capacitance is preferably smaller than 1Ω, and further preferably lower than 0.5Ω. The inhibition on various interferences caused by BCI, conduction and coupling can meet the requirements of CIRS25 and ISO7637.

Figure 1:
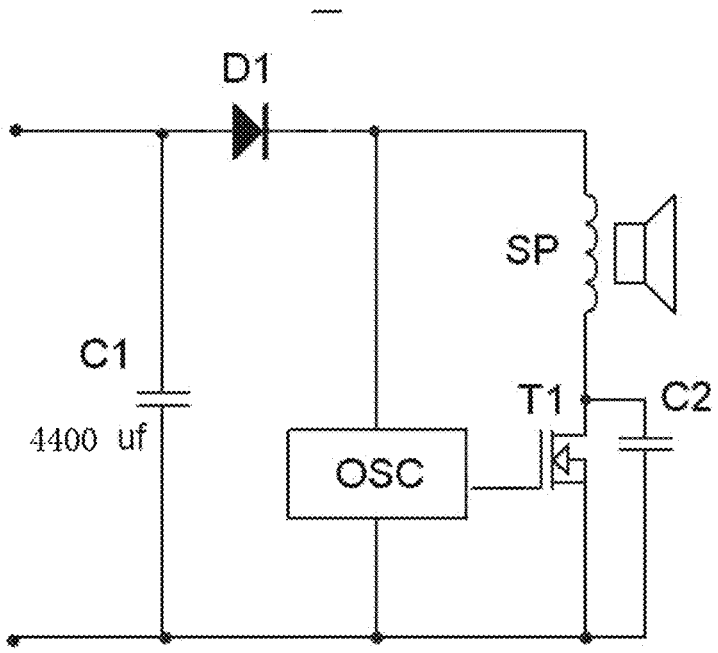
FIG. 1 is a motor vehicle horn of an embodiment of the present invention.

FIG. 1 is a motor vehicle horn of an embodiment of the present invention. As shown in FIG. 1, the motor vehicle horn comprises a coil SP, an oscillation circuit OSC provides a driving signal for a power amplifier circuit T1, the power amplifier circuit generates a power current signal, and the power current signal enables the coil SP to make a sound after filtered by a capacitor C2.

At least one capacitor C1 with the overall capacitance of about 220-10000 microfarads is connected to the horn power source input terminal in parallel to eliminate the electrical interference caused by electromagnetic radiation, conduction and/or coupling. In another example, the capacitance of the parallel-connected at least one capacitor is large enough, such that the internal resistance relative to the working frequency (300-600 Hz) of the horn is reduced to (mΩ) level.

In the example, the high frequency low internal resistance electrolytic capacitor of 4400 microfarads is adopted, such that each index of the electronic horn EMC totally accords with the standard. The improvement on the electromagnetic capacitor is very small if the capacitance is larger than 10000 microfarads, and no great significance is generated due to the factors of capacitance volume and cost.

Figure 2:
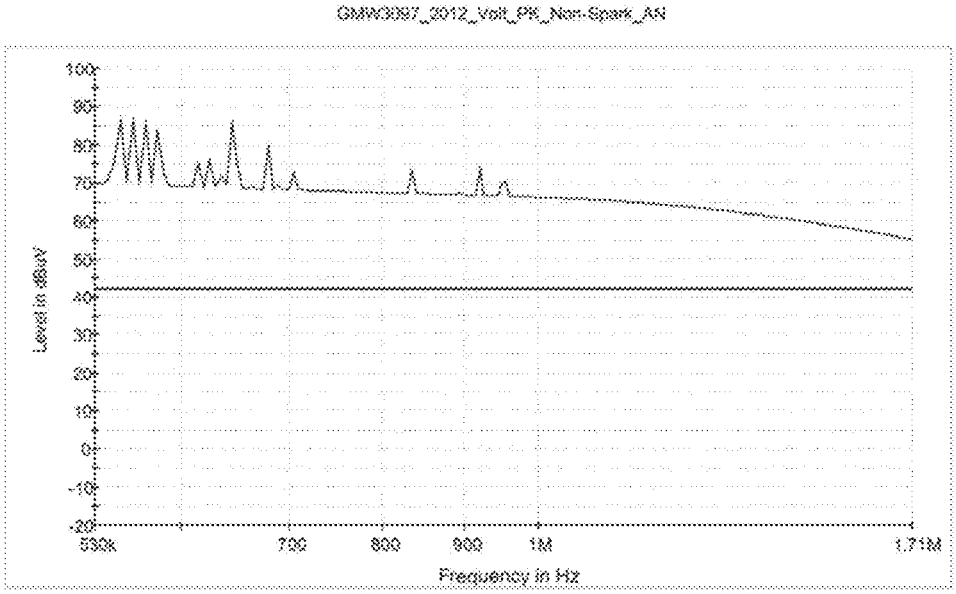
FIG. 2 is a test pattern that no capacitor of more than 220-1000 microfarads is added to a horn power source terminal in a frequency band of 0.53-1.7 MHz in a CIRS25 test.

FIG. 2 is a test pattern that no capacitor which is more than 220-1000 microfarads is added to a horn power source end in a frequency band of 0.53-1.7 MHz in a CIRS25 test. As shown in FIG. 2, the standard requires that the radiation does not exceed 42 dBuV, but in fact, the maximum value has reached 87 dBuV, and is much too over the limit.

Figure 3:
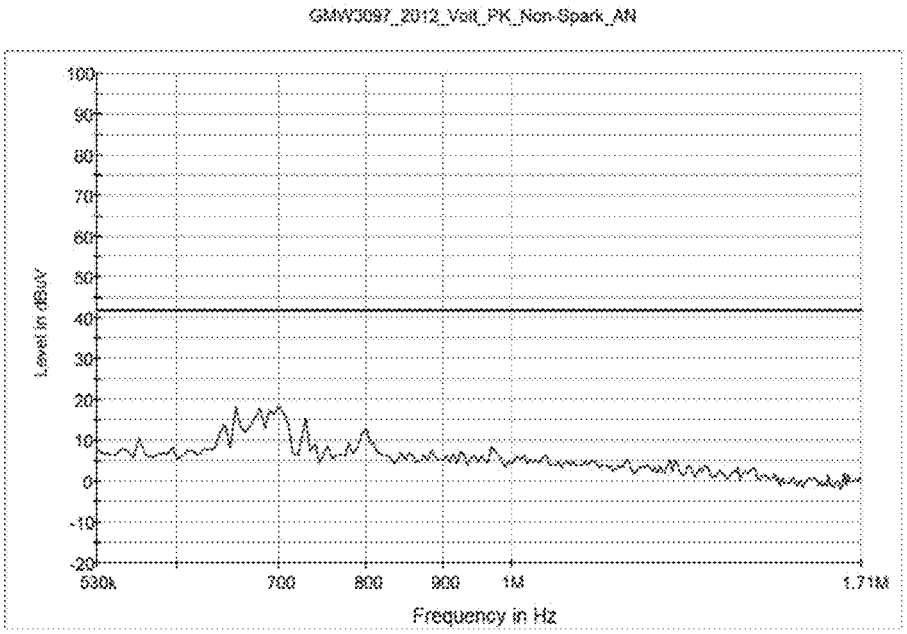
FIG. 3 is a test pattern that a capacitor of 4400 microfarads is added to a horn power source end in a frequency band of 0.53-1.7 MHz in a CIRS25 test.

FIG. 3 is a test pattern that a capacitor which is 4400 microfarads is added to a horn power source end in a frequency band of 0.53-1.7 mhz in CIRS25 test, the standard requires that the radiation does not exceed 42 dBuV, but in fact, the maximum value only reaches 18 dBuV, thus the effect is very obvious.

The method for eliminating the conducted emission and radiated emission interference by connecting 1 or more capacitors with the overall capacitance of 220-10000 microfarads to two ends of a vehicle-mounted terminal electronic apparatus (device) is very effective to eliminate the conducted emission and radiated emission interference of an electromechanical horn, besides being widely applied to various electronic horns, and the application space of the electromechanical horn can be greatly expanded. The method can also be applied to the elimination of the conducted emission and radiated emission interferences of various vehicle-mounted electronic apparatuses and devices. The method can also be applied to a wire bundle connected to a whole vehicle electrical appliance apparatus of the motor vehicle.

In another embodiment, in the electromechanical horn for motor vehicles and/or water crafts, a capacitor with the overall capacitance of about 220-10000 microfarads is connected to the horn power source input terminal, so as to eliminate the electrical interference caused by electromagnetic radiation, conduction and coupling. The overall capacitance of the capacitor is preferably about 500-6000 microfarads, and further preferably about 1000-4000 microfarads.

In another embodiment, the method can be applied to the electronic device of the motor vehicles and/or water crafts, at least one capacitor with the overall capacitance of about 220-10000 microfarads is connected to the power source input terminal in parallel, so as to eliminate the electrical interference caused by electromagnetic radiation, conduction and coupling.

In another embodiment, in the motor vehicles and/or water crafts comprising the electronic device, at least one capacitor is connected to a power supply end or circuit of the electronic device in parallel, the capacitance of the capacitor is large enough and has the overall capacitance of about 220-10000, so as to eliminate the electrical interference caused by electromagnetic radiation, conduction and coupling.

The above specific embodiments further describe the objective, technical solution and beneficial effects of the present invention in detail, it is understandable that the above is merely specific embodiments of the present invention rather than limiting a protection scope of the present invention, and any modifications, equivalent substitutions and improvements made within the spirit and principle of the present invention should be within the protection scope of the present invention.

The invention claimed is:

1. An electronic device for a motor vehicle or water craft, comprising:

input terminals for connecting the electronic device to a power supply;

at least one capacitor of about 220-10000 μF connected in parallel with input terminals of the power supply to eliminate outbound electrical interference caused by electromagnetic radiation, conduction, or coupling that is generated by the electronic device.

2. The electronic device according to claim 1, wherein the electronic device is an electronic or electromechanical horn for the motor vehicle or water craft.

3. A vehicle, comprising:

an electronic device according to claim 2;

wherein the vehicle is a motor vehicle or a water craft.

4. The electronic or electromechanical horn for motor vehicle or water craft as claimed in claim 2, wherein the at least one capacitor has an overall capacity of about 500-6000 μF.

5. The electronic device for used in a motor vehicle or a water craft as claimed in claim 1, wherein the at least one capacitor has an overall capacity of about 470-6000 μF.

6. The motor vehicle or water craft as claimed in claim 3, wherein the at least one capacitor has an overall capacity of about 470-6000 μF.

7. The electronic or electromechanical horn for motor vehicle or water craft as claimed in claim 2, wherein the at least one capacitor has an overall capacity of about 1000-4000 μF.

8. The electronic device for used in a motor vehicle or a water craft as claimed in claim 1, wherein the at least one capacitor has an overall capacity of about 1000-4000 μF.

9. The motor vehicle or water craft as claimed in claim 3, wherein the at least one capacitor has an overall capacity of about 1000-4000 μF.

10. The electronic device for used in a motor vehicle or a water craft as claimed in claim 1, wherein an internal resistance relative to a working frequency of the electronic device is less than 2Ω.

11. A method of eliminating electromagnetic interference of an electronic device in a motor vehicle or a water craft, comprising:

coupling at least one capacitor of about 220-10000 μF in parallel with input terminals of a power supply of the electronic device to eliminate outbound electrical interference caused by electromagnetic radiation, conduction, or coupling that is generated by the electronic device.

12. The method according to claim 11, wherein the electronic device is an electronic or electromechanical horn.

13. The method according to claim 11, wherein the electromagnetic interference is of the motor vehicle or the water craft having the electronic device.

14. The electronic or electromechanical horn for motor vehicle or water craft as claimed in claim 12, wherein the at least one capacitor has an overall capacity of about 470-6000 μF.

15. The method of eliminating electromagnetic interference of electronic device for using in motor vehicle or water craft as claimed in claim 11, wherein the at least one capacitor has an overall capacity of about 470-6000 μF.

16. The method of eliminating electromagnetic interference of a motor vehicle or water craft having an electronic device as claimed in claim 13, wherein the at least one capacitor has an overall capacity of about 470-6000 μF.

17. The electronic or electromechanical horn for motor vehicle or water craft as claimed in claim 12, wherein the at least one capacitor has an overall capacity of about 1000-4000 μF.

18. The method of eliminating electromagnetic interference of electronic device for using in motor vehicle or water craft as claimed in claim 11, wherein the at least one capacitor has an overall capacity of about 1000-4000 μF.

19. The method of eliminating electromagnetic interference of a motor vehicle or water craft having an electronic device as claimed in claim 13, wherein the at least one capacitor has an overall capacity of about 1000-4000 μF.

* * * * *